United States Patent [19]

Golland et al.

[11] 3,950,192

[45] Apr. 13, 1976

[54] CONTINUOUS CARBURIZING METHOD

[75] Inventors: David I. Golland, Cary; Nicholas K. Harakas, Raleigh; John W. Mottern, Cary; Gary E. O'Connor; Charles J. Runkle, both of Raleigh, all of N.C.

[73] Assignee: Monsanto Company, St. Louis, Mo.

[22] Filed: Oct. 30, 1974

[21] Appl. No.: 519,365

[52] U.S. Cl. ..... 148/16.5; 148/16; 148/153; 148/156

[51] Int. Cl.[2] ..... C21D 1/45

[58] Field of Search ..... 148/12.1, 16.5, 144, 153, 148/156; 266/3 R

[56] References Cited

UNITED STATES PATENTS

| | | | |
|---|---|---|---|
| 1,932,032 | 10/1933 | Cowan | 148/16.5 |
| 2,513,713 | 7/1950 | Cope | 148/16.5 |
| 2,955,062 | 10/1960 | Cullen et al. | 148/16.5 |
| 3,356,541 | 12/1967 | Cullen | 148/16.5 |
| 3,877,684 | 4/1975 | Kurihara | 148/156 |

*Primary Examiner*—Walter R. Satterfield
*Attorney, Agent, or Firm*—Donald J. Fitzpatrick

[57] ABSTRACT

An improved method for continuously carburizing low carbon cold rolled coil stock is disclosed. The carburized product is characterized by the absence of proeutectoid ferrite. The method comprises heating low carbon steel stock in the austenitizing range of 950°–1150°C. (1750°–2100°F.) in a continuous heat treating furnace wherein the furnace contains a high carbon availability so that residence time is of a short duration; homogenizing the stock so as to attain uniform macro distribution of carbon across the length, width and thickness of the stock and quenching the stock so that a uniform micro distribution of carbon is attained.

11 Claims, 4 Drawing Figures

CONTINUOUS CARBURIZING METHOD

BACKGROUND OF THE INVENTION

1. Field of the Invention

This invention relates to a method for continuously carburizing low carbon coil stock and more particularly to a method for carburizing coil stock of less than about 20 mils thick wherein the carbon content is increased by rapid carbon diffusion.

2. Description of the Prior Art

It is well known in the art that the carbon content of steel can be increased by carburization. For example, U.S. Pat. No. 2,531,731 teaches the carburization of low carbon rimmed steel after cold reduction. Another method for carburizing steel is disclosed in U.S. Pat. No. 2,513,713. In this patent light gage, low carbon steel strip is heated to and maintained at an elevated temperature and continuously carburized by passing the strip through a sealed furnace in the presence of a carburizing atmosphere so that the atmosphere reacts with the strip. The strip is then quenched and normalized. The method disclosed in this patent, although teaching continuous carburization of steel strip, has some serious deficiencies. Namely, uniform carbon distribution across the width of the sheet is not obtained. This nonuniformity necessitates trimming the edges after carburization. To improve carbon distribution the patentee employs two forms of heating. The strip is heated by electric resistance heating which is referred to as internal heating and the carburizing chamber is also heated to avoid radiation heat loss from the strip. The resultant strip is thereafter quenched in a lead bath and then re-austenitized to provide "material soft enough to be handled without difficulty". From a metallurgical standpoint, it is reasonable to assume that the microstructure probably contains coarse pearlite, cementite and proeutectoid ferrite depending upon the final carbon content of the strip.

Although carbon distribution and strip microstructure significantly affect the mechanical properties of the strip these parameters are also important for another reason, namely, response to subsequent heat treatment. If, for example, the carburized strip is to exhibit a tensile strength in excess of 300 KSI the strip must receive a heat treatment so that an appropriate microstructure, such as fine grain tempered martensite, can be obtained. Such a microstructure cannot be practically achieved if the strip, prior to heat treatment, contains substantial amounts of coarse pearlite and proeutectoid ferrite and carbon distribution is not uniform. The product produced by the method disclosed in U.S. Pat. No. 2,513,713 contains a non-uniform carbon distribution and micro-constituents not amenable to a rapid response to heat treatment.

Carbon for diffusion into low carbon steel is supplied by enriching an endothermic carrier gas with a hydrocarbon gas. In the continuous carburization of steel strip the amount of hydrocarbon gas employed, viz, methane is generally maintained at about 5% by volume of the carrier gas. Controlling the amount of hydrocarbon gas added to enrich the carrier gas is important for two reasons, (a) an excessive amount of free carbon can be generated in the form of soot and can deposit on the surface of the carburized stock, (b) the amount of carbon available for carburization cannot exceed the amount that can be absorbed by diffusion into a low carbon stock of specific thickness.

It is common practice to supply only enough carbon that can be readily absorbed by the stock. This is accomplished in the continuous carburization of steel strip by maintaining a low percentage of hydrocarbon gas in the carburization gas. A result of keeping carbon availability low is long residence times within the carburizing furnace. To reduce residence time and carburizing costs carbon availability could be increased. To do so however would result in sooting on the surface of the carburized stock. Therefore, carbon availability, cross-sectional area and minimum soot formation must all be considered when considering any carburizing process. To achieve adequate carburization and no sooting the prior art employs long residence time and low carbon availability. As used hereinafter carbon availability is defined as the ratio of: pounds of carbon per hour entering the furnace to pounds of steel per hour passing through the furnace.

The method of the present invention rapidly carburizes steel strip by passing the strip through a furnace so that the residence time is of a short duration and thereafter treating the carburized strip in such a manner so as to prevent the formation of proeutectoid ferrite. The high through-put thus obtained permits in-line quenching, after carburization, thereby developing a unique microstructure.

SUMMARY OF THE INVENTION

The present invention relates to a method of continuously carburizing low carbon steel strip less than 20 mils thick wherein the carburized strip is characterized by the absence of proeutectoid ferrite. The strip is heated in a carburizing furnace into the austenitizing range of 950°–1150°C. (1750°–2100°F.). The thickness of the strip to be carburized and carbon availability are correlated so that a short residence time can be realized. The carburized strip is thereafter homogenized so as to attain a uniform macro distribution of carbon across the length, width and thickness of the strip. The product is then quenched at a rate sufficient to prevent the formation of any proeutectoid ferrite and produce a uniform micro distribution of carbon.

The present invention allows light gage coils particularly black plate coils wherein black plate is defined as, a product of the cold reduction method in gages no. 29 and lighter (thicknesses 0.0141 inches and under) to be continuously carburized. The resultant product is characterized by a specific microstructure, that is, the absence of proeutectoid ferrite and an essentially soot-free surface.

The invention comprises the following steps:

- heating low carbon steel stock in a strip form in the austenitizing range of 950°–1150°C. (1750°–2100°F.) in a continuous heat treating furnace containing a high carbon availability so that residence time of said stock is of short duration;
- homogenizing said stock so as to attain a uniform macro distribution of carbon across the length, width and thickness of said stock, and
- quenching said stock at a temperature below 600°C. (950°F.) from the austenitizing range in less than about 10 seconds whereby a uniform micro distribution of carbon is attained.

It is therefore an object of this invention to provide a method for carburizing cold rolled stock wherein a uniform distribution of carbon across the stock's length, width and thickness is achieved.

Another object of this invention is to provide a method for carburizing cold rolled stock in a short residence time.

A further object of this invention is to provide a method for carburizing cold rolled stock wherein the resultant microstructure is free of proeutectoid ferrite.

A still further object of this invention is to provide a method for carburizing wherein carbon availability in the carburizing gas is high.

Another object of this invention is to provide a method for in-line carburization, homogenization and quenching wherein a unique microstructure is obtained.

Another object of this invention is to provide a method for carburizing wherein the carburized stock has a soot-free surface.

DETAILED DESCRIPTION OF THE PREFERRED EMBODIMENT

Figure 1:
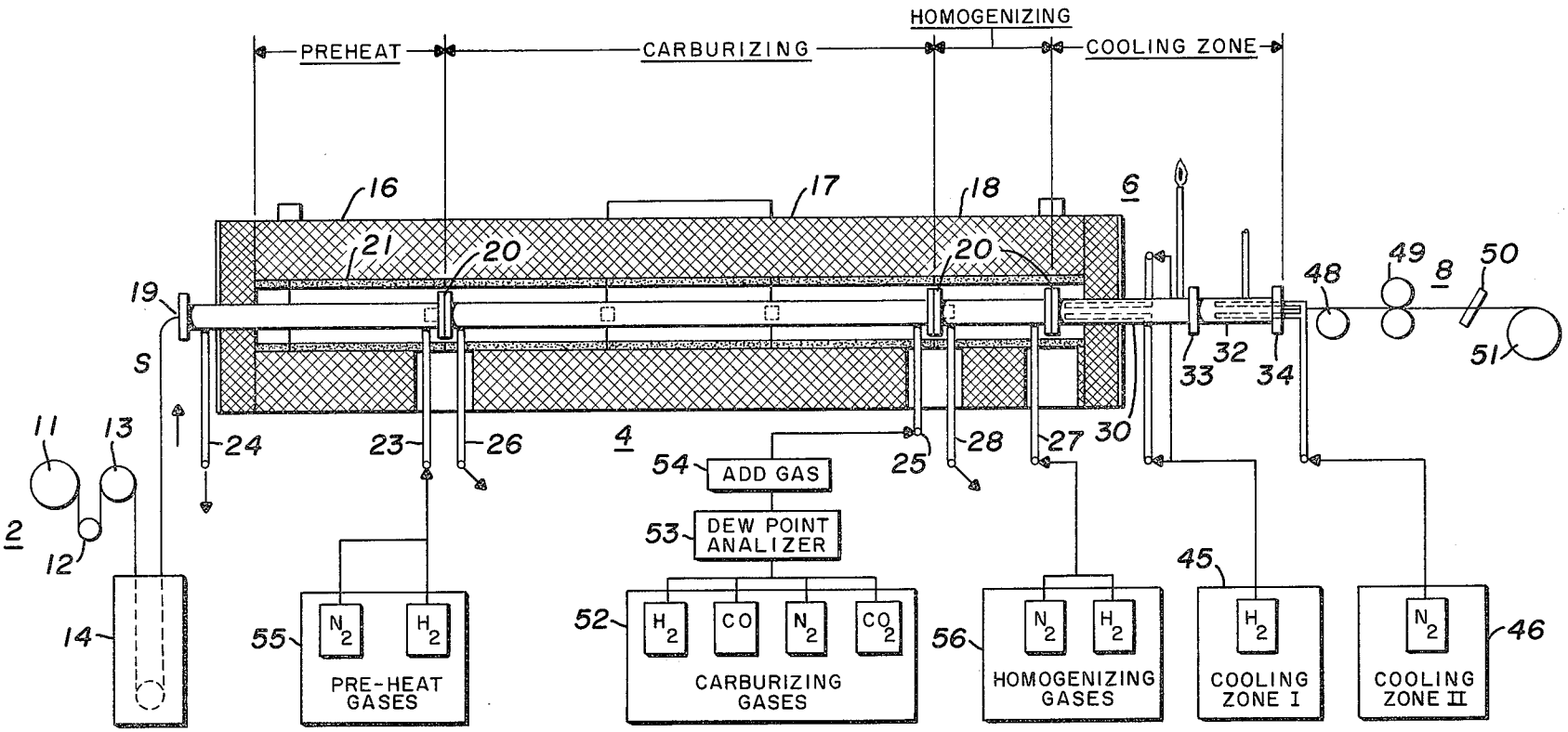
FIG. 1 is a schematic of a continuous carburizing line.

In conducting the process of this invention low carbon steel strip such as black plate with an initial carbon content of about 0.08% can be continuously carburized on a carburizing line having a preheat zone, carburizing zone, and homogenization zone to a homogeneous product with a final carbon content of at least 0.50% and then quenched in a cooling zone so that the carburized strip microstructure is essentially all fine pearlite. This process is carried out so that residence time of the strip within the carburizing zone is of a short duration, that is, less than 10 minutes.

The present invention is an advance over the prior art because uniform carbon distribution can be achieved while at the same time the strip is exposed to a short residence time within the carburizing zone. These two parameters, uniform carbon distribution and residence time are therefore the most significant aspects of this invention.

Uniform carbon distribution as discussed in this specification is considered in the context of carbon distribution on a macro and micro scale. Uniformly distributed carbon on a macro scale after carburization means that on a qualitative basis diffused carbon is distributed uniformly along the length, width and thickness of the strip. Macro distribution is achieved by homogenizing the strip at 980°–1040°C. (1800°–1900°F.) in a homogenization zone after it leaves the carburization zone. Carbon distribution on a micro scale means that on a quantitative basis, carbon, in the finished strip, is present as a homogeneous micro-constituent in fine pearlite or bainite. Such a distribution is obtained by immediately quenching the strip as it exits from the homogenization zone. The strip is quenched from a temperature within the austenitizing range to about 600°C. in less than about 10 seconds. This rapid rate of cooling prevents austentite from transforming into proeutectoid ferrite and/or coarse lamelar pearlite. Therefore, the absence of these micro-constituents will insure that the strip microstructure will be characterized by a uniform micro distribution of carbon. It should be noted that a micro distribution of carbon cannot be achieved unless a macro distribution is first produced by homogenizing the as-carburized strip.

The other key aspect of this invention, short residence time, is achieved by employing a carburization temperature higher than that normally used in the prior art namely in the range of 950°–1150°C. (1750°–2100°F.). The normal carburization temperature used in the prior art is about between 900°–941°C. (1650°–1725°F.). In conjunction with this elevated temperature a high carbon availability is utilized. As hereinbefore described carbon availability is the ratio of pounds of carbon entering the furnace to pounds of steel passing through the furnace. In the prior art carbon availability is construed to mean that quantity of carbon available from the decomposition or cracking of the hydrocarbon enriching gas component of the carburizing atmosphere, e.g, methane, wherein methane would decompose into carbon plus hydrogen. Consequently, the prior art does not consider carbon availability in the same context as we do, namely as a ratio between carbon entering the furnace to steel passing through the furnace. This is a most significant distinction between the method of this invention and prior art methods of carburization. Generally speaking, the prior art teaches a low carbon availability. Carbon availability was maintained at a low level because it is believed that higher levels of carbon are deliterious causing soot to form on the surface of the carburized part. Therefore, in order to minimize soot formation the amount of carbon provided for diffusion into the lower carbon part was deliberately kept low. We have found that the surface to volume ratio of the part that we are carburizing, i.e., wide, light gage strip, is such that all the available carbon readily diffuses into the strip and none deposits as soot on the strip surface. Accordingly, we are able to increase the carbon availability above the prior art level without soot forming on the surface of the sheet. We consider a ratio of less than 0.010 as a low carbon availability. For example, in conventional case carburizing, a well known technique of the prior art, a carbon availability of 0.004 has been employed. In the method of this invention we use a high carbon availability, that is, about 0.010 and less than about 0.080. A carbon availability below 0.010 would result in long residence times and not achieve the objects of this invention. A carbon availability in excess of 0.080 could result in soot formation on the strip surface.

We consider short residence time and fast strip speeds within the furnace as being synonymous terms. Expressed another way this means that strip can be carburized rapidly in a short carburizing furnace. The ability to utilize smaller carburizing furnaces means a lower capital expenditure is required to build a carburizing line for carburizing strip of say 20 mils thickness.

Further, we have found that soot formation on the work piece surface is essentially not encountered even with an introduction of up to 50% methane in the carburization gas. This methane level is approximately ten times greater than prior art methane levels. We are able to work with higher levels of carbon availability by controlling the strip thickness and carburization temperature. That is, if strip thickness is less than 20 mils and a carburization temperature in the range of 950°–1150°C. (1750°–2100°F.) is used there will be no sooting on the strip surface. A residence time of less than 10 minutes can also be employed. A short residence time when equated with fast line speeds is also important for another reason. In order to rapidly quench the carburized strip to achieve the heretofore described micro carbon distribution the strip must pass rapidly from the homogenization zone into the quench zone. This cannot be accomplished with long residence times, i.e. slow line speeds.

Referring now to FIG. 1 of the drawings, there is shown a representative continuous carburizing line 1 for carrying out the present invention. The line consists of the following principal components, an entry station 2 for delivering low carbon coil stock designated as S into carburizing furnace proper 4, a cooling zone 6 for rapidly cooling stock S after passage through the carburizing furnace and a collection station 8 for rewinding the carburized product. A gas mixing station 10 supplies the necessary carburizing atmosphere to the carburizing furnace.

Entry station 2 includes a reel 11 for positioning a low carbon coil such as conventional AISI C1008 black plate. As the coil is payed out it wraps around tension roll 12 and guide roll 13. As will be hereinafter more fully described, these elements cooperate with like elements in the collection system 8 for maintaining proper strip tension in line 1. The strip passes into cleaning tank 14 wherein residual rolling oils and mill dirt are removed and thereafter into furnace proper 4.

Furnace proper 4 is an elongated structure that consists of a series of zones. The strip initially enters a preheat zone 16 wherein the strip is heated up to the austenitizing temperature. A neutral gas, for example nitrogen and hydrogen, is distributed from preheat gas station 55 and flows counter to the path of the strip. The gas enters at preheat gas entry pipe 23 and discharges at exit pipe 24. Adjacent the preheat zone is carburizing zone 17 wherein the strip temperature is elevated to 950°–1150°C. (1750°–2100°F.). A carburizing atmosphere containing a high carbon availability that is, in the range of about 0.010 to about 0.080 is passed through the zone so that the carbon content of the strip is rapidly increased by diffusion of the carbon from the atmosphere into the strip. As the strip leaves this zone the carbon distribution is non-uniform across the strip thickness. The carbonaceous atmosphere enters this zone at gas entry pipe 25 and discharges at exit pipe 26 positioned at the downstream end of the carburizing zone. Adjacent the carburizing zone is a homogenization zone 18. In this zone the carbon that diffused into the strip in the carburizing zone is uniformly distributed across the width, length and thickness of the strip. In this zone a uniform macro distribution of carbon is obtained. The strip is maintained at a temperature above 800°C. in this zone. A neutral gas, similar to that circulated in the preheat zone, or one with a low carbon availability is distributed from homogenizing gas station 56 and flows counter to the path of the strip S. The gas enters at homogenizing gas entry pipe 27 positioned at the downstream end of the homogenizing zone. Baffles 20 separate the preheat, carburizing and homogenization zones from each other so that gases cannot flow from one zone into an adjacent zone. A strip guide means 19 extends longitudinally throughout the furnace zones and the cooling zone. This guide maintains strip alignment and tension within the respective zones. An elevated temperature, up to 1150°C. (2100°F.) is maintained within furnace proper 4 by heating element 21.

Figure 2:
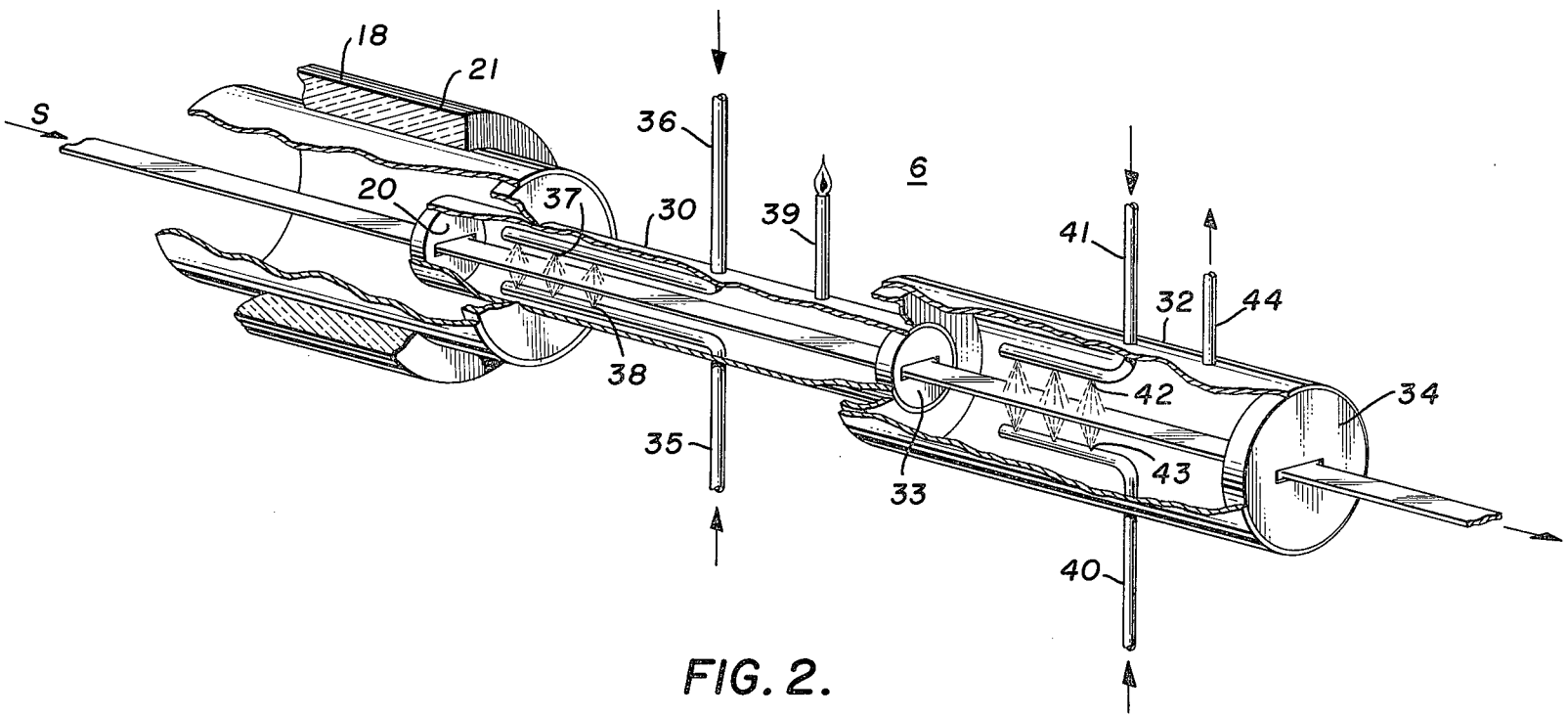
FIG. 2 is an enlarged schematic partially cut-away showing a cooling zone.

Positioned immediately adjacent homogenizing zone 18 is cooling zone 6. Baffle 20 separates these two zones. In this zone the temperature of the strip is rapidly reduced so that austenite is prevented from transforming into proeutectoid ferrite. Referring now to FIG. 2 it can also be seen that this zone includes a first cooling zone 30 and a second cooling zone 32. In the first cooling zone 30 a pair of inlet pipes 35 and 36 distribute a cooling gas, for example, hydrogen, onto the top and bottom surfaces of the strip through a plurality of orifices indicated at 37 and 38 to facilitate rapid quenching from approximately above 800°C. to approximately 600°C. within about 10 seconds wherein transformation of the strip microstructure is completed. The gas is distributed from gas supply station 45 and exits at pipe 39. A baffle 33 separates the two cooling zones. The initially cooled strip then enters second cooling zone 32 where in the same manner as the first cooling zone a cooling gas such as nitrogen enters at inlet pipes 40 and 41 from gas supply station 46 and is distributed onto the top and bottom surfaces of the strip through a plurality of orifices indicated at 42 and 43. The strip is cooled to ambient temperature and thereafter exits into the atmosphere. The microstructure of the strip clearly shows a uniform carbon distribution on a quantitative basis. The gas exits at pipe 44. End plate 34 seals the end of the cooling zone proper.

The strip leaves the cooling zone and passes onto collecting station 8. This station includes a guide roll 48 and a pair of tension rolls 49. These elements, i.e., the guide roll and tension rolls, cooperate with tension roll 12 and guide roll 13 to maintain tension on the strip within the furnace proper and also aid in pulling the strip through the carburizing process. An oiler 50 distributes a light protective coating onto the surface of the strip which is thereafter recoiled on takeup reel 51.

Gas mixing station 10 furnishes the carburizing atmosphere for carburizing zone 17. The station includes gas supply area 52 wherein an endothermic gas including hydrogen, carbon monoxide, nitrogen and carbon dioxide are mixed in predetermined amounts. A dew point analyzer 53 measures and controls the dew point of the gas supply. A hydrocarbon gas such as methane is added at location 54 so that the carburizing gas has the desired carbon availability.

As hereinbefore discussed two parameters, residence time and uniform carbon distribution are the most significant aspects of this invention.

The method of this invention can increase the carbon content from 0.08% to 0.60% in 10 mil thick black plate with residence times of less than 10 minutes. This can be accomplished by employing a high carbon availability and a carburizing temperature in the range of 950°–1150°C. (1750°–2100°F.).

In Table I and Table II, laboratory samples were 1 inch wide, 10 mil coils, and production samples were 24 inches wide, 10 mil coils.

Table I shows the residence time required to obtain a 0.60% carbon content in the aforementioned samples by varying carburizing temperature and hydrocarbon gas concentration. The gas employed in each instance was methane. The surfaces of the carburized strips were not contaminated by soot formation.

Table I

| Temperature | Methane Level | Residence Time for 0.6% C Laboratory Samples | Production Samples |
|---|---|---|---|
| 1800°F | 10% | 8.5 Minutes | 8.5 Minutes |
| 1800°F | 20% | 7 Minutes | 6.5 Minutes |
| 1800°F | 30% | 6 Minutes | |
| 1800°F | 40% | 5 Minutes | |
| 1900°F | 10% | 5 Minutes | >6 Minutes |
| 1900°F | 20% | 3.5 Minutes | 3.5 Minutes |
| 1900°F | 30% | <3 Minutes | |
| 1900°F | 40% | >2 Minutes | |

Short residence times are attainable because the method of this invention employs a high carbon availability. Table II shows carbon availability data for several carburizing runs using 1 inch wide and 24 inch wide, 10 mil coil stock. Carbon availability is also compared to the carbon availability employed in the prior art, i.e., conventional case carburizing. It is readily apparent that the carbon availability used in the method of this invention is considerably greater than the prior art. The carbon availability data shown in the accompanying table is for AISI C1008 black plate stock carburized to 0.06% carbon. As the dimensions of the stock changes or carburization level varies carbon availability will also change. The carbon availability for each example is within the desired range of 0.010 to 0.080. It should also be noted that the methane level indicated in this table is 10–30% whereas the case carburized sample employs a methane level of 5%.

Table II

| Sample Identification | Carburizing Temp.(°F.) | Methane Level | A lbs. C./Hr. | B lbs. Steel/Hr. | Carbon Availability (A/B) |
|---|---|---|---|---|---|
| Laboratory Samples | 1800 | 10% | 0.04 | 1.36 | 0.029 |
| | 1800 | 30% | 0.12 | 2.04 | 0.059 |
| | 1900 | 10% | 0.04 | 2.47 | 0.016 |
| | 1900 | 30% | 0.12 | 4.09 | 0.029 |
| Production Samples | 1800 | 10% | 5.34 | 123 | 0.043 |
| | 1800 | 20% | 10.68 | 170 | 0.063 |
| | 1900 | 10% | 5.34 | 170 | 0.031 |
| | 1900 | 20% | 10.68 | 315 | 0.034 |
| Case Carburizing | | 5% | 9.34 | 2,300 | 0.004 |

Uniform carbon distribution along the length of a coil and across the coil width will be achieved if there is uniform temperature and gas distribution within the furnace proper. Table III is a tabulation of carbon analyses taken every 100 ft., from the right and left edges of a 10 mil, 24 inches wide, 2,300 ft. long coil produced according to the method of this invention.

Table III

| | Right Edge | Left Edge | | Right Edge | Left Edge |
|---|---|---|---|---|---|
| 100′ | 0.62 | 0.62 | 1300′ | 0.62 | 0.61 |
| 200′ | 0.62 | 0.64 | 1400′ | 0.61 | 0.63 |
| 300′ | 0.61 | 0.63 | 1500′ | 0.62 | 0.61 |
| 400′ | 0.62 | 0.61 | 1600′ | 0.62 | 0.63 |
| 500′ | 0.61 | 0.60 | 1700′ | 0.60 | 0.62 |
| 600′ | 0.61 | 0.61 | 1800′ | 0.60 | 0.62 |
| 700′ | 0.62 | 0.61 | 1900′ | 0.60 | 0.62 |
| 800′ | 0.61 | 0.61 | 2000′ | 0.60 | 0.61 |
| 900′ | 0.61 | 0.62 | 2100′ | 0.60 | 0.62 |
| 1000′ | 0.62 | 0.62 | 2200′ | 0.60 | 0.61 |
| 1100′ | 0.60 | 0.62 | 2300′ | 0.58 | 0.60 |
| 1200′ | 0.60 | 0.62 | | | |

Uniform carbon distribution on a macro or qualitative basis can be shown in Table IV.

Table IV

| | Percent Carbon as-carburized | homogenized at 1100°C. |
|---|---|---|
| analysis 10 mil strip | 0.57 | 0.58 |
| analysis of strip after removing 2.5 mils from each side | 0.46 | 0.57 |

The as-carburized sample was not homogenized in a manner taught by this invention and has a carbon gradient indicating nonuniform distribution of carbon through the strip cross-section. The homogenized sample shows uniform carbon distribution on a qualitative basis.

Figure 3:
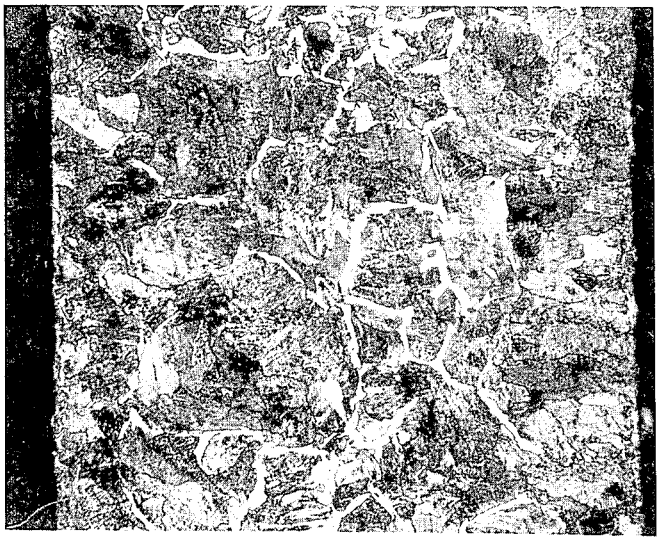
FIG. 3 is a photomicrograph showing the microstructure of a carburized strip that was not homogenized and quenched.
Figure 4:
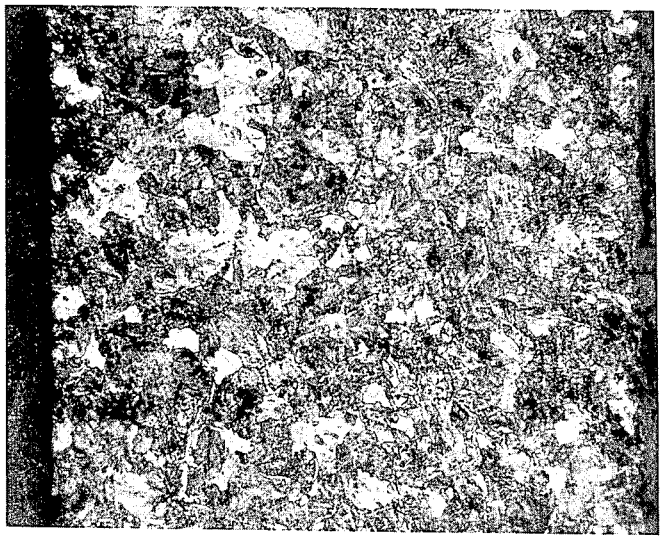
FIG. 4 is a photomicrograph showing the microstructure of a carburized strip that was treated according to the method of this invention.

Uniform carbon distribution on a micro or quantitative basis can be shown by reference to FIGS. 3 and 4. FIG. 3 is a photomicrograph of an as-carburized strip. The microstructure contains coarse lamelar pearlite and considerable amounts of proeutectoid ferrite which precipitate on former austenite grain boundaries. FIG. 4 is a photomicrograph of a carburized strip that was gas quenched in cooling zone 6 immediately after leaving the homogenization zone 18. The microstructure is predominantly all fine pearlite with a few particles of proeutectoid ferrite which precipitate on former austenite grain boundaries. These ferrite particles should not be confused with the large areas of light etching pearlite. Furthermore, the carbon content is uniform throughout the cross-section.

The method of the present invention can be illustrated by the following example. This example is merely illustrative and is not intended as a limitation upon the scope of the invention described herein.

SPECIFIC EXAMPLE

Continuous carburizing run — C209, sample number 2

1. Starting material — C1008 black plate, 10 mil by one-inch wide.

2. Preheat zone — temperature — 1040°C. atmosphere — 95% $N_2$, 5% $H_2$; residence time — 3 minutes.

3. Carburizing zone — temperature — 1040°C.; atmosphere — 10% methane, balance endothermic carrier gas (approximate analysis — 40% $N_2$, 40% $H_2$, 20% CO); residence time 6 minutes; carbon availability 0.020.

4. Homogenization zone — temperature — 1040°C.; atmosphere — 95% $N_2$, 5% $H_2$; residence time — 2 minutes.

5. Cooling zone — first zone, $H_2$ quench to about 600°C.; second zone, $N_2$ quench to ambient temperature.

6. Finished product — composition equivalent to C1060, 0.60% carbon, microstructure — predominantly, fine pearlite and a soot-free surface.

As used herein the term "predominantly fine pearlite" may possibly include very small traces of proeutectoid ferrite, that is, less than 5% by volume. This small amount of proeutectoid ferrite may transform from austenite, upon cooling, due to inefficient quenching.

We claim:

1. In the method of continuously carburizing black plate stock wherein the carburized stock has an essentially soot-free surface and a microstructure substantially free of proeutectoid ferrite, comprising the steps of:

a. providing black plate stock in coil form; b. heating said stock in the austenitization range of 950°–1150°C in a continuous heat treating furnace containing a carburizing atmosphere consisting essentially of a hydrocarbon gas and an endothermic gas wherein said gas has a carbon availability in the range of about 0.010 to about 0.080 so that residence time of said stock in said furnace is less than about 10 minutes;

c. homogenizing said stock in the austenitizing range of 800°–1040°C so as to attain a uniform macro distribution of carbon across the length, width and thickness of said stock; and d. quenching said stock at a temperature below about 600°C from the austenitizing range by impinging gas jets on the surfaces of said stock so as to attain a uniform micro distribution of carbon.

2. A method as recited in claim 1 wherein said black plate stock has a carbon content of less than about 0.10%.

3. A method as recited in claim 1 wherein the carbon content is increased to at least 0.50%.

4. A method as recited in claim 1 wherein step (b) further comprises:

e. establishing said carbon availability by correlating the amount of carbon entering said furnace to the amount of steel passing through said furnace so as to achieve a specific carbon content in said carburized strip.

5. A method as recited in claim 1 wherein said hydrocarbon gas is methane.

6. A method as recited in claim 5 wherein said methane concentration in said carburizing atmosphere is from 10% to about 50%.

7. A method as recited in claim 6 wherein said methane concentration is from about 10% to about 30%.

8. A method as recited in claim 1 wherein step (c) further comprises:

f. supplying a neutral atmosphere during said homogenization.

9. A method as recited in claim 1 wherein step (d) further comprises: (h) quenching said stock in a first cooling zone and a second cooling zone, wherein in said first zone the temperature of said stock is reduced below about 600°C, and in said second zone said stock temperature is reduced to ambient temperature.

10. A method as recited in claim 9 wherein step (h) further comprises:

i. impinging hydrogen gas upon the strip surfaces in said first zone and impinging nitrogen gas on the strip surfaces in said second zone.

11. A method as recited in claim 1 wherein said quenching yields a microstructure of predominantly fine pearlite.

* * * * *